US009714666B2

(12) United States Patent
Schafer et al.

(10) Patent No.: US 9,714,666 B2
(45) Date of Patent: Jul. 25, 2017

(54) COOLING FAN MODULE

(75) Inventors: Tilman Schafer, Edewecht (DE); Thomas Dreesen, Oldenburg (DE)

(73) Assignee: BROSE FAHRZEUGTEILE GMBH & CO. KG, Wurzburg (DE)

( * ) Notice: Subject to any disclaimer, the term of this patent is extended or adjusted under 35 U.S.C. 154(b) by 735 days.

(21) Appl. No.: 14/117,484

(22) PCT Filed: May 10, 2012

(86) PCT No.: PCT/EP2012/002004

§ 371 (c)(1),
(2), (4) Date: Mar. 12, 2014

(87) PCT Pub. No.: WO2012/156045

PCT Pub. Date: Nov. 22, 2012

(65) Prior Publication Data

US 2014/0186172 A1 Jul. 3, 2014

(30) Foreign Application Priority Data

May 13, 2011 (DE) ..... 10 2011 075 801
May 7, 2012 (DE) ..... 10 2012 207 552

(51) Int. Cl.
*F04D 29/52* (2006.01)
*F04D 29/16* (2006.01)
(Continued)

(52) U.S. Cl.
CPC ..... *F04D 29/526* (2013.01); *F01P 5/06* (2013.01); *F04D 29/164* (2013.01);
(Continued)

(58) Field of Classification Search
CPC ..... F01P 5/06; F04D 29/164; F04D 29/326; F04D 29/526
See application file for complete search history.

(56) References Cited

U.S. PATENT DOCUMENTS 2,640,646 A * 6/1953 Jones ..... F04D 29/703 415/211.2
4,487,017 A * 12/1984 Rodgers ..... F02K 1/386 181/220

(Continued)

FOREIGN PATENT DOCUMENTS

AT E 25 540 B 8/1987
DE 4014496 C1 7/1991

(Continued)

OTHER PUBLICATIONS

Korean Office Action for Korean Patent Application No. 10-2013-7032752, dated Jul. 9, 2015, 12 pages.

(Continued)

*Primary Examiner* — Woody Lee, Jr.
(74) *Attorney, Agent, or Firm* — Westman, Champlin & Koehler, P.A.

(57) ABSTRACT

The invention relates to a cooling fan module for a motor vehicle, having a fan impeller which has a multiplicity of fan impeller blades which are connected to one another via a fan impeller outer ring, having a frame, on which the fan impeller is mounted, having an annular reverse flow guide device, which has an inner ring and an outer ring and which is designed to de-spin a reverse flow between the inner ring and the outer ring and to mix said reverse flow with the slot flow between inner ring and fan impeller outer ring.

5 Claims, 14 Drawing Sheets

Figure 1:
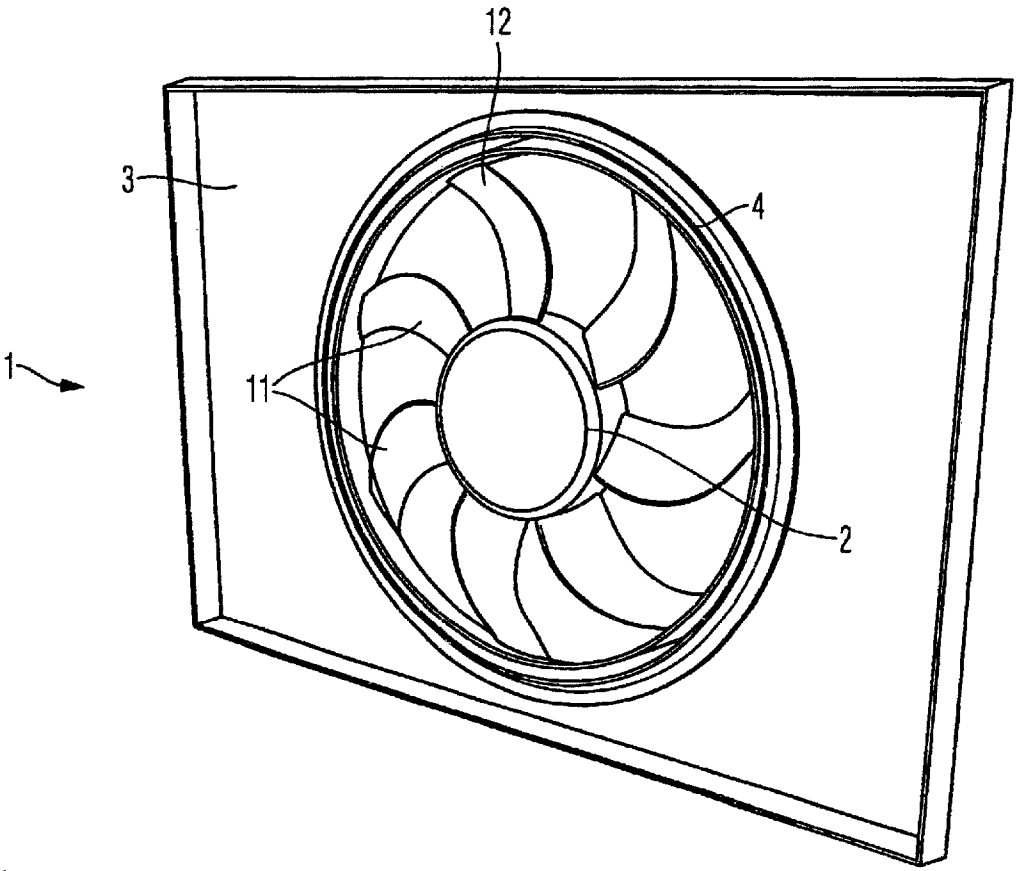

(51) Int. Cl.
*F04D 29/32* (2006.01)
*F01P 5/06* (2006.01)
*F04D 29/66* (2006.01)

(52) U.S. Cl.
CPC ..... *F04D 29/326* (2013.01); *F04D 29/663* (2013.01); *F04D 29/665* (2013.01); *F04D 29/666* (2013.01)

(56) References Cited

U.S. PATENT DOCUMENTS

| | | | | |
|---|---|---|---|---|
| 5,297,931 | A * | 3/1994 | Yapp | F01D 5/141 415/208.1 |
| 5,423,660 | A * | 6/1995 | Sortor | F01P 5/06 416/189 |
| 5,489,186 | A * | 2/1996 | Yapp | F01D 5/141 415/208.3 |
| 6,082,969 | A * | 7/2000 | Carroll | F04D 17/06 416/169 A |
| 6,276,127 | B1 * | 8/2001 | Alberti | F02K 1/386 60/262 |
| 6,606,854 | B1 * | 8/2003 | Siefker | B63G 13/02 181/213 |
| 9,334,877 | B2 * | 5/2016 | Nicholls | F04D 29/52 |
| 2005/0019152 | A1 * | 1/2005 | Seitz | F01D 5/145 415/58.5 |
| 2006/0216147 | A1 | 9/2006 | Park | |
| 2006/0280598 | A1 * | 12/2006 | Alexander | F04D 29/668 415/173.1 |
| 2007/0224044 | A1 * | 9/2007 | Hong | F04D 29/547 415/211.2 |
| 2010/0111667 | A1 * | 5/2010 | Stagg | F04D 17/06 415/1 |
| 2011/0250066 | A1 * | 10/2011 | De Roche | B64C 11/001 415/214.1 |

FOREIGN PATENT DOCUMENTS

| | | | |
|---|---|---|---|
| DE | 69524169 | T2 | 7/2002 |
| DE | 10 2007 036 304 | A1 | 2/2009 |
| DE | 10 2008 046 508 | A1 | 3/2010 |
| DE | 11 2008 000 850 | T5 | 3/2010 |
| EP | 1 830 072 | A2 | 9/2007 |
| EP | 1 830 072 | A3 | 3/2008 |
| EP | 2 236 788 | A1 | 10/2010 |
| EP | 2 386 764 | A2 | 11/2011 |
| FR | 2 816 360 | A1 | 5/2002 |
| GB | 2 358 677 | A | 8/2001 |
| JP | H07501593 | A | 2/1995 |
| KR | 10-2004-0057357 | A | 7/2004 |
| KR | 10-2009-0127353 | A | 12/2009 |
| WO | 93/05275 | A1 | 3/1993 |
| WO | 98/37319 | A1 | 8/1998 |
| WO | 2008/124656 | A1 | 10/2008 |

OTHER PUBLICATIONS

Communication from German Patent Office for German Patent Application No. 10 2012 207 552.6, dated Dec. 4, 2015, 4 pages.
Search Report for German Patent Application No. DE 10 2012 207 552.6, dated Jul. 4, 2012, 8 pages.
Examination Report for European Patent Application No. 12727282.1, dated Nov. 4, 2015, 4 pages.
Office Action for Chinese Patent Application No. 201280034577.3, dated Jun. 16, 2015, 10 pages.
Second Office Action, including Search Report, for Chinese Patent Application No. 2012800345773, dated Feb. 25, 2016, 8 pages.

* cited by examiner

COOLING FAN MODULE

CROSS-REFERENCE TO RELATED APPLICATION

This Application is a Section 371 National Stage Application of International Application No. PCT/EP2012/002004, filed May 10, 2012 and published as WO 2012/156045 A2 on Nov. 22, 2012, which is based on and claims the benefit of priority from German Patent Application No. DE 10 2011 075 801.1, filed on May 13, 2011 and German Patent Application No. DE 10 2012 207 552.6, filed on May 7, 2012, the contents of which are hereby incorporated by reference in their entirety.

FIELD OF THE INVENTION

The present invention relates to a cooling fan module.

TECHNICAL BACKGROUND

Cooling fan modules are used to cool the engine in motor vehicles. The general aim is to manufacture such cooling fan modules as economically as possible. The comfort of the vehicle occupants is also a further aspect, especially with regard to minimising the noise generated by the cooling fan module.

A cooling fan module typically consists of a fan impeller, in which a motor to drive the fan impeller is located, and a frame which comprises assembly struts for fixing the fan impeller. The fan impeller of a cooling fan module is designed to produce an air flow with which the heat generated by the engine is to be removed. The cooling fan modules used at present have what is known as a gap flow in addition to the main flow. The gap flow refers to the flow which forms between the fan impeller and the frame due to negative pressure and which tends to swirl due to the rotation of the fan impeller. The swirling gap flow works against the main flow, leading to a negative impact on the flow behaviour of the cooling fan module. This defective flow sometimes leads to a very high level of noise being generated, reducing the comfort of the passengers during vehicle operation.

DE 10 2008 046 508 A1 describes a fan device for ventilating a combustion engine for a motor vehicle having at least one fan impeller with fan impeller blades for air intake, said blades connecting at least one fan impeller casing to a fan impeller hub, having at least one fan frame in which at least one fan impeller is located, a first gap being formed between at least one fan impeller casing section and one fan frame section such that it runs radially, at least in part, with respect to a main air flow direction and in the direction of the centrifugal force arising when the fan impeller is moved in rotation, in order to minimise at least one air flow.

DE 10 2007 036 304 A1 describes a device for cooling an engine, comprising a heat exchanger through which air can flow, a fan located in the region of the heat exchanger having a fan shaft, and a fan cowl located on the heat exchanger, said fan cowl surrounding a flow chamber between the fan and the heat exchanger and being delimited by an outer chamber, a gap through which air can flow being provided in the region of a radial outer circumference of the fan by means of the fan cowl, a gap flow from the flow chamber being able to flow through said gap into the outer chamber, causing the gap flow to flow into the outer chamber in a different radial direction to the fan shaft.

SUMMARY OF THE INVENTION

Against this background, an object of the present invention is to provide an improved cooling fan module for a motor vehicle.

This object is achieved according to the invention by a cooling fan module having the features in claim 1.

A cooling fan module for a motor vehicle is accordingly proposed having a fan impeller which comprises a large number of fan impeller blades which are connected to one another via a fan impeller outer ring, having a frame on which the fan impeller is mounted, having an annular reverse flow guide device which comprises an inner ring and an outer ring and which is designed to de-spin a reverse flow between the inner ring and the outer ring and to mix said reverse flow with the gap flow between the inner ring and the air impeller outer ring.

The concept underlying the invention entails guiding the swirling reverse flow in a preferred direction and de-spinning it by means of a reverse flow guide device provided specifically for this purpose. The reverse flow guide device rectifies the reverse flow again so that this no longer swirls, and mixes said reverse flow with the flow which flows between the inner ring of the reverse flow guide device and the fan impeller outer ring. The flow in the main flow thus remains vortex-free, even after mixing with the flow mixed with the reverse flow by the reverse flow guide device such that a vortex-free flow reaches the fan blades. As a result, the noise emitted by the cooling fan module is reduced. This thus also leads to improved flow behaviour of the cooling fan module, which increases the effectiveness of the cooling fan module.

Advantageous embodiments and developments of the invention emerge from the additional subordinate claims and from the description with reference to the drawing figures.

In a typical embodiment, the reverse flow guide device is located between the frame and the fan impeller. Depending on the design of the guide device, the fan impeller outer ring is either located between the inner ring and the outer ring of the guide device or within the inner ring in a radial direction.

In one embodiment, the reverse flow guide device comprises a large number of air guide fins which are provided between the inner ring and the outer ring and which extend from the inner ring to the outer ring, in a radial direction for example. These air guide fins enable the swirling reverse flow to be rectified even better, thus improving the flow behaviour of the cooling fan module even more.

In a further preferred embodiment, the air guide fins and/or the transition are designed elastically such that the fan impeller can be inserted through the guide device. In this way the cooling fan module can be mounted in a very simple fashion.

In a further preferred embodiment, the entire inner ring is designed elastically such that the fan impeller can be inserted through the guide device.

In a further preferred embodiment, the frame with the air guide device having the elastic transition and/or the elastic air guide fins is designed as a single-piece two-component injection-moulded part. The costs of manufacturing the cooling fan module can be significantly reduced in this manner.

In a further preferred embodiment, the frame is made from a thermoset plastics material and the guide device having the elastic transition and/or the elastic air guide fins is made from a thermoplastic or elastomer plastics material. In a further preferred embodiment, just the air guide fins or just the transition may be made from a thermoplastic or elastomer plastics material.

In a further preferred embodiment, the fan impeller comprises a further fan impeller outer ring which is connected to the fan impeller outer ring by a large number of outer ring air guide fins. The outer ring air guide fins are designed so as to generate a radial air flow between the fan impeller outer ring and the second fan impeller outer ring. The radial air flow may flow from the inside to the outside or from the outside to the inside depending on the orientation of the outer ring air guide fins. The efficiency of the cooling fan module can be improved even more in this manner. This preferred embodiment of the fan impeller may also be used and inserted in other devices, such as ventilators, turbines, compressors, etc, which do not have a reverse flow guide device, for example.

In a further preferred embodiment, the frame and the reverse flow guide device are designed together as a single piece. This embodiment of the cooling fan module is particularly advantageous with regard to low manufacturing costs for the cooling fan module.

In a further preferred embodiment, the frame is designed as a plastic injection-moulded part. The cooling fan module can be manufactured particularly economically in this manner. Thermoplastic, thermoset and/or elastomer plastics materials, for example, are suitable plastics materials for the frame and reverse flow guide device. However, the frame and the reverse flow guide device can also be manufactured from other materials such as a metallic material, and by a different manufacturing method, e.g. milling.

In a further preferred embodiment, a motor is provided which drives the fan impeller. The motor may, for example, be designed as a brushless direct current motor which is located in the hub of the fan impeller. However, other motor models can also be used with the cooling fan module according to the invention.

In a further preferred embodiment, the cooling fan module is preferably designed as an axial fan. However, it would also be conceivable and advantageous if the cooling fan module were designed as a diagonal fan or a radial fan. Other models of cooling fan modules can also be equipped with a reverse flow guide device.

The above embodiments and developments can be combined in any conceivable combination as long as this is reasonable. Further possible embodiments, developments and uses of the invention also include combinations of features of the invention described previously or below with respect to the embodiments, even if not explicitly specified. In particular, persons skilled in the art will also add individual aspects as improvements or additions to the respective basic form of the present invention in this case.

CONTENT OF THE DRAWINGS

Figure 2:
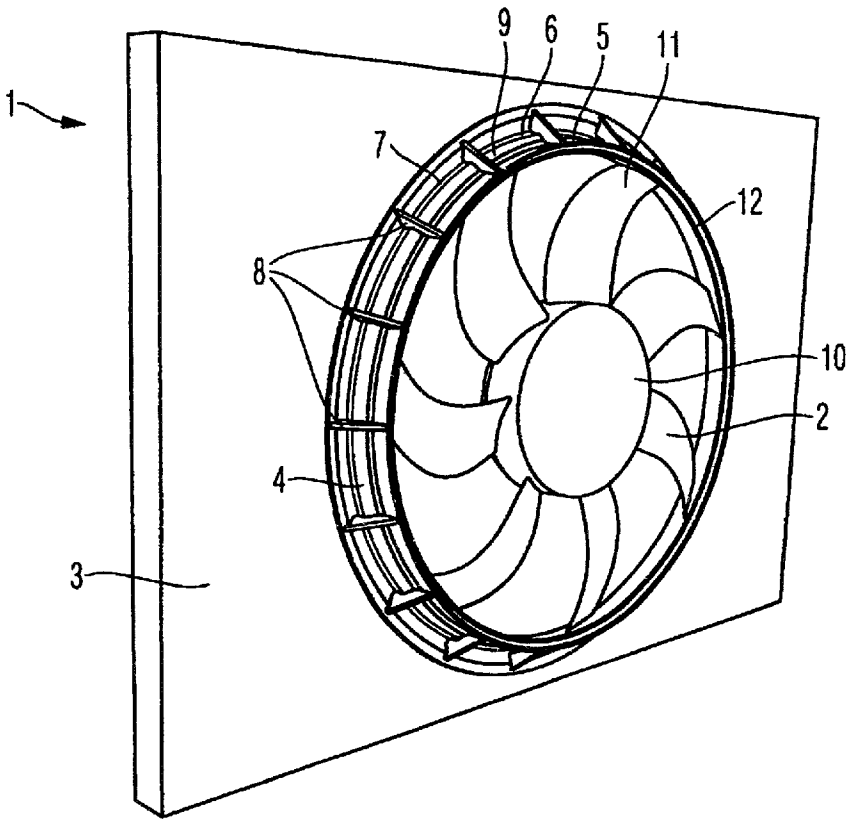
Figure 3:
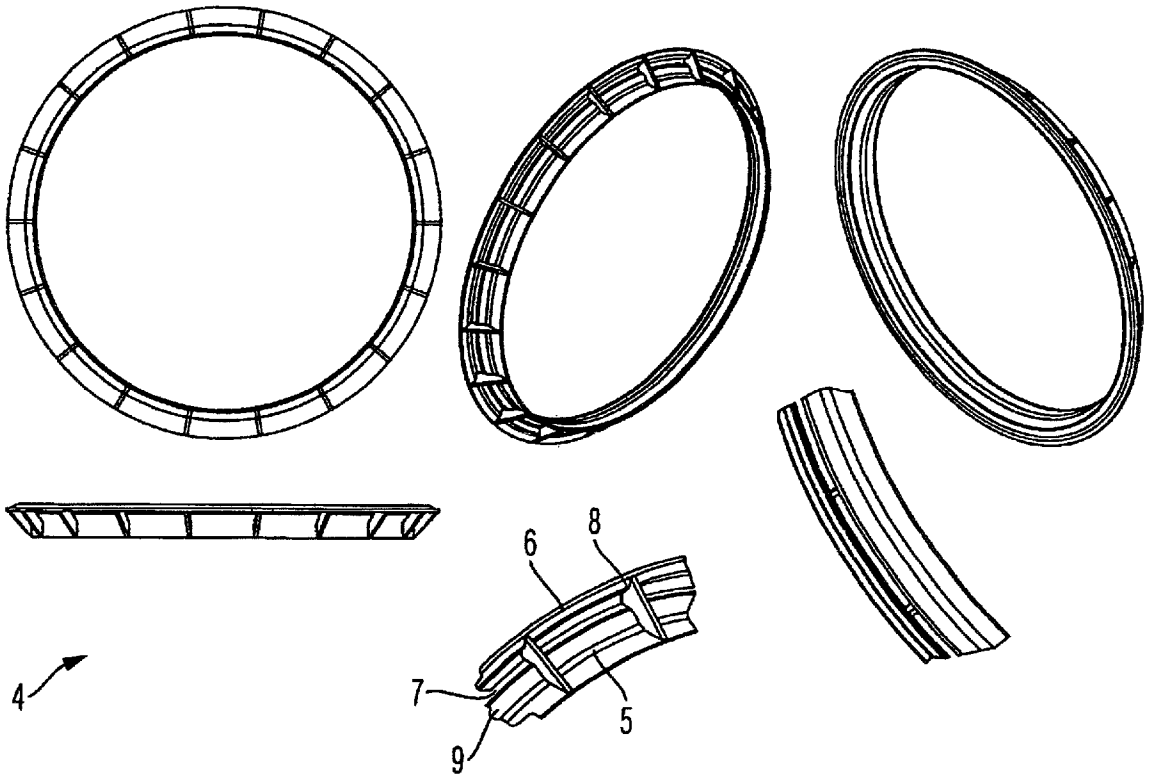
Figure 4:
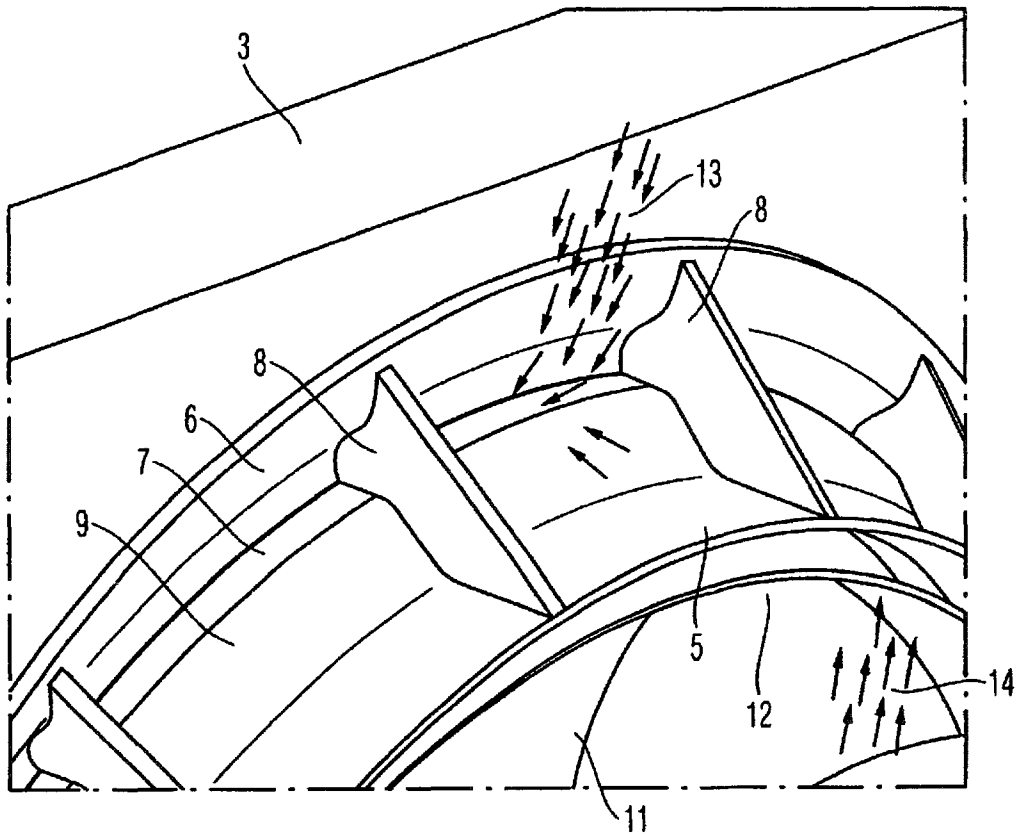
Figure 5:
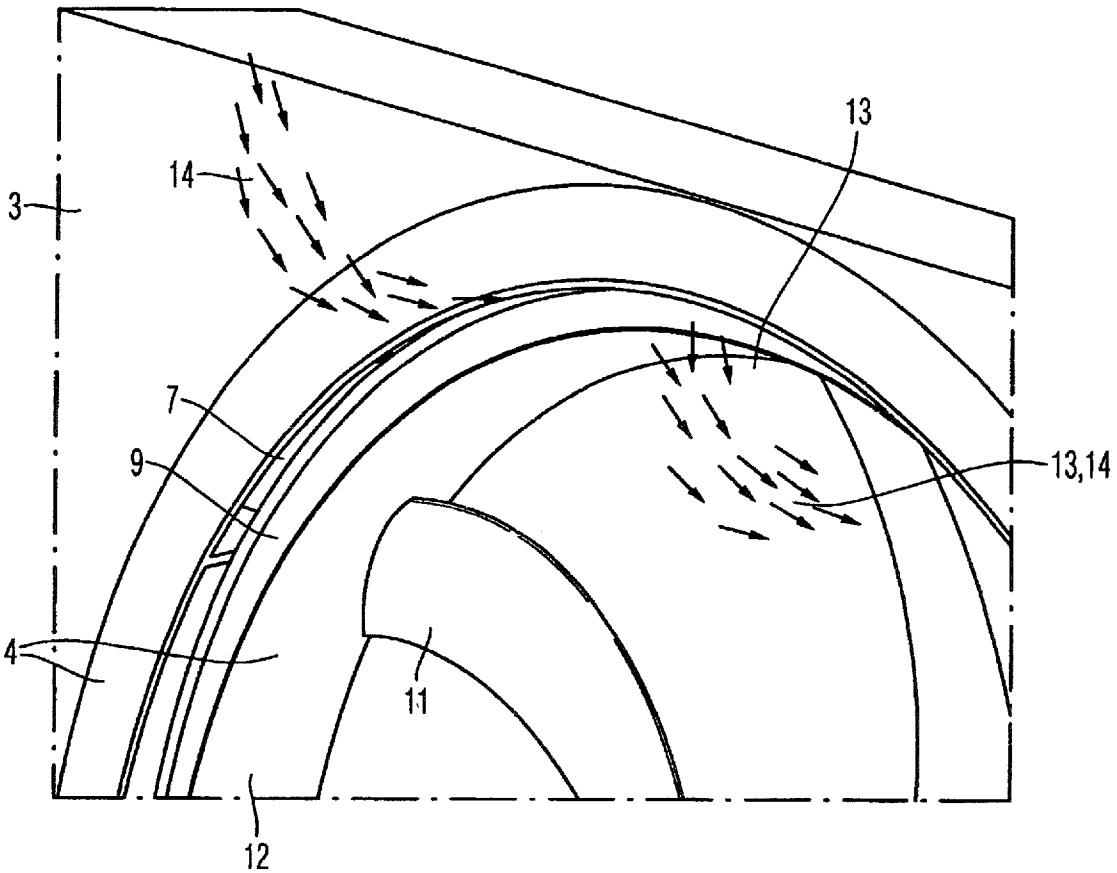
Figure 6:
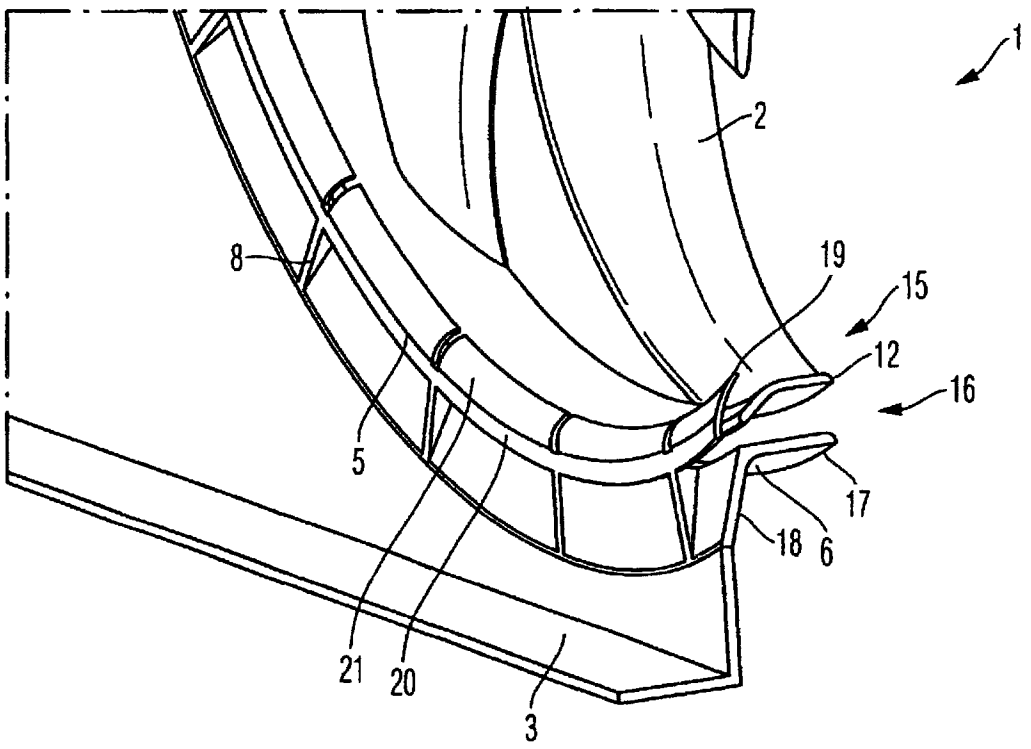
Figure 7:
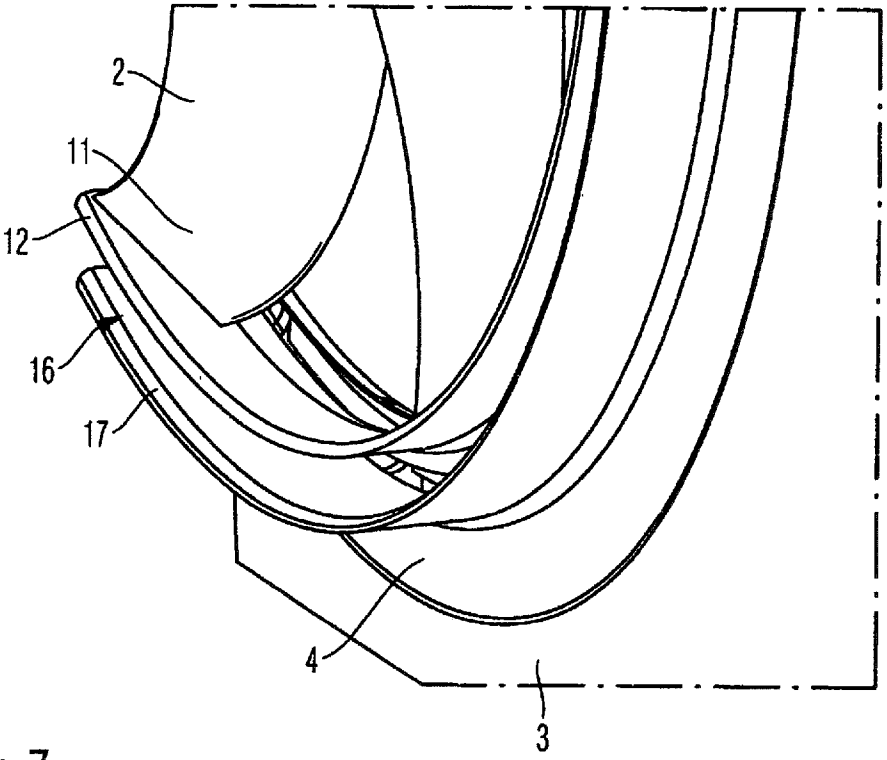
Figure 8:
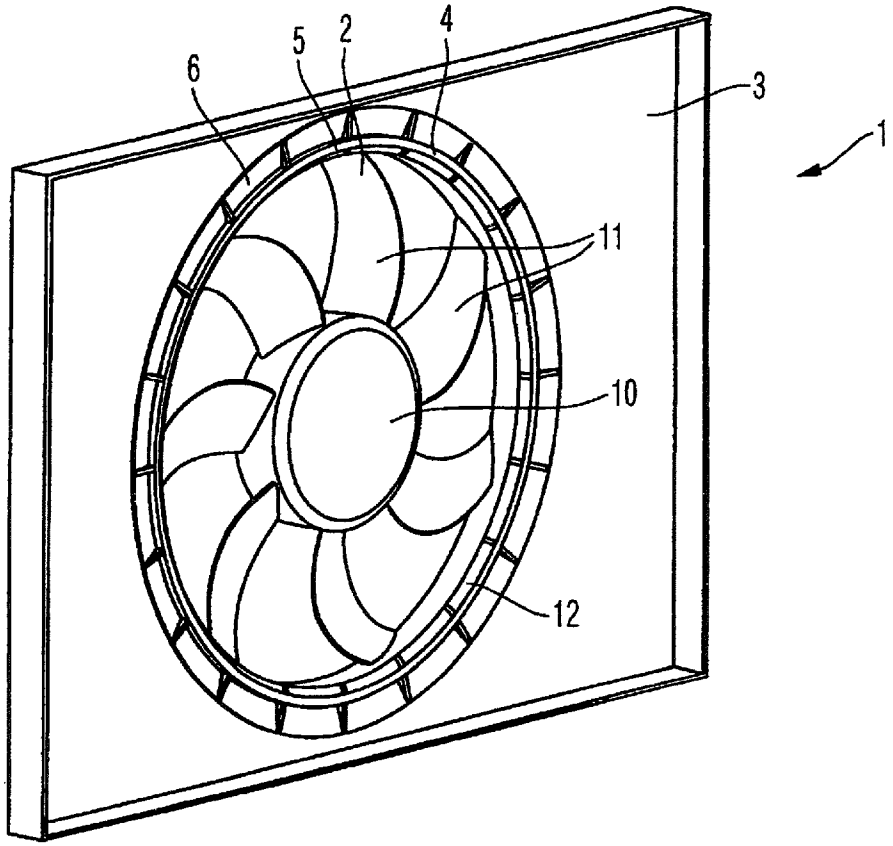
Figure 9:
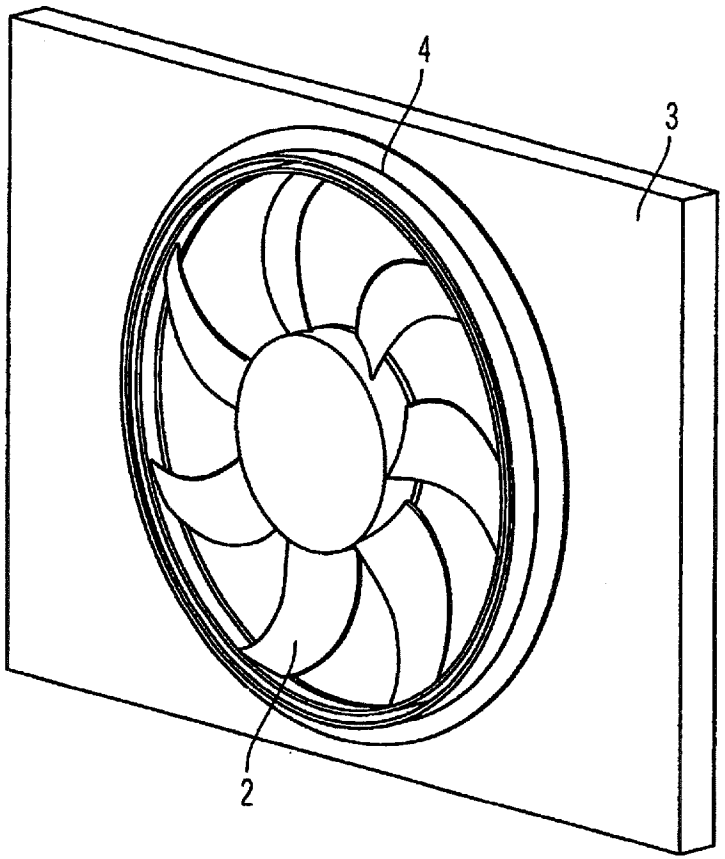
Figure 10:
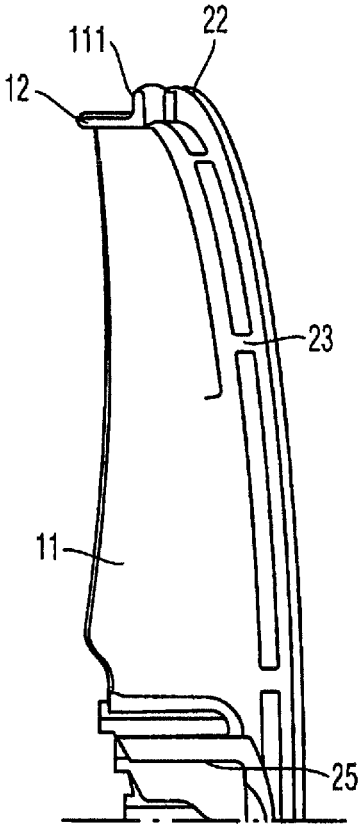
Figure 11:
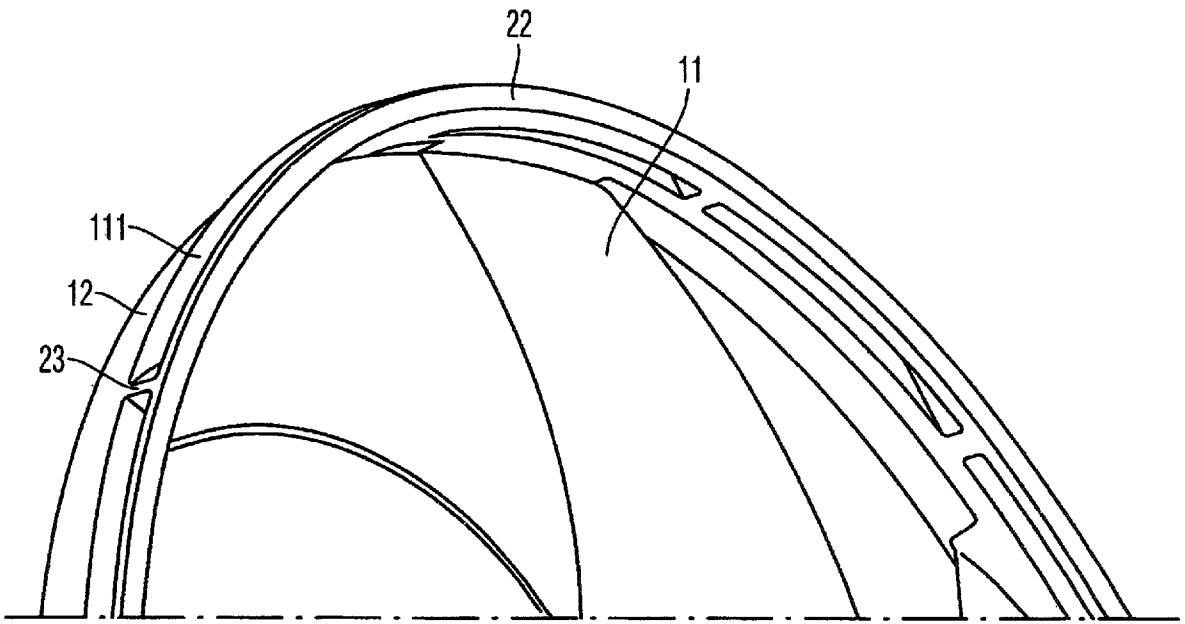
Figure 12:
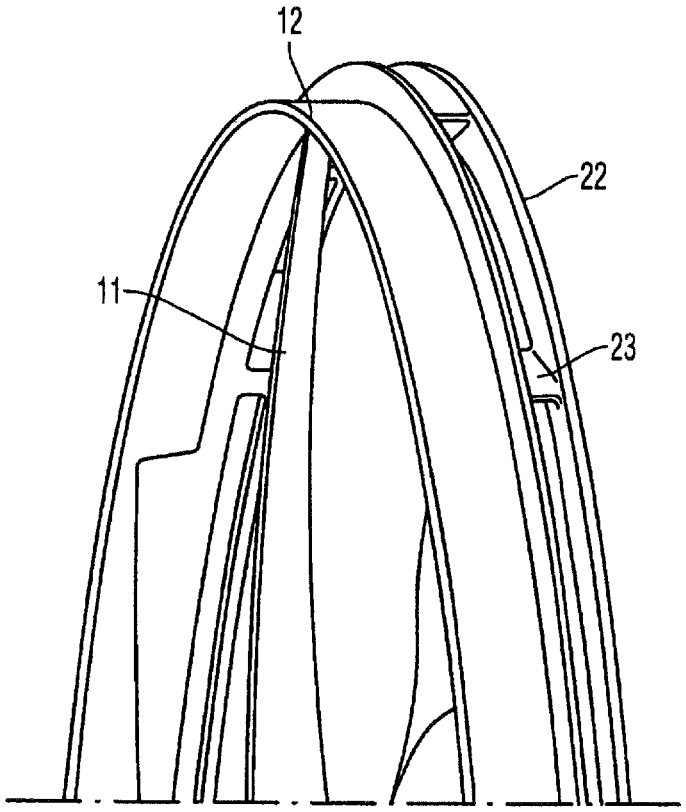
Figure 13:
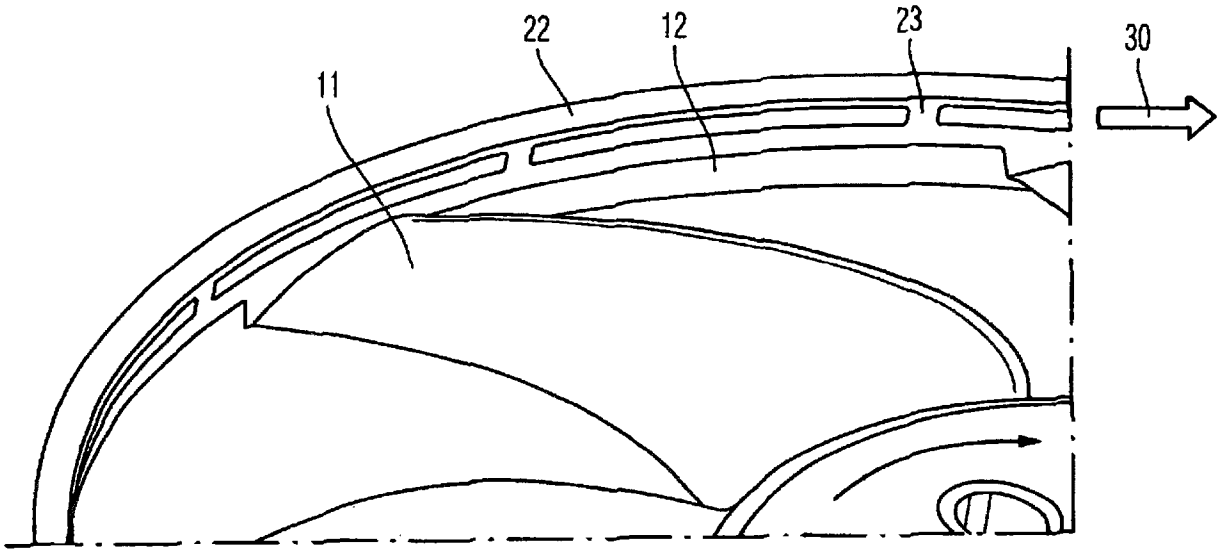
Figure 14:
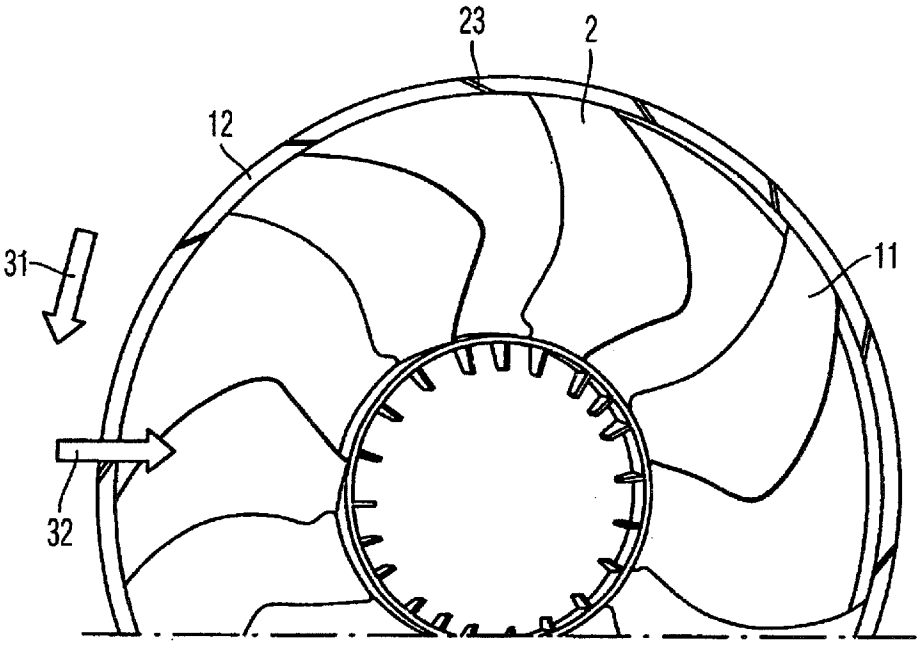

The present invention is explained below in greater detail with the aid of embodiments specified in the schematic figures in the drawings. These are as follows:

FIG. 1 a perspective front view of a cooling fan module;

FIG. 2 a perspective rear view of a cooling fan module shown in FIG. 1;

FIG. 3 various views of a reverse flow guide device;

FIG. 4 a flow diagram for the cooling fan module from the rear;

FIG. 5 a flow diagram for the cooling fan module from the front;

FIG. 6 a perspective sectional view of a further embodiment of a cooling fan module;

FIG. 7 a perspective rear view of a section of the cooling fan module shown in FIG. 6;

FIG. 8 a perspective front view of the cooling fan module;

FIG. 9 a perspective rear view of the cooling fan module;

FIG. 10 a sectional view of an embodiment of a fan impeller;

FIG. 11 a perspective front view of the fan impeller according to FIG. 10;

FIG. 12 a perspective side view of the fan impeller shown in FIG. 10;

FIG. 13 a perspective top view of the fan impeller shown in FIG. 10; and FIG. 14 a perspective sectional view of the fan impeller shown in FIG. 10.

The accompanying drawings should convey further understanding of the embodiments of the invention. They illustrate embodiments of the invention and clarify the principles and concepts behind the invention in conjunction with the description. Other embodiments and many of the described advantages are apparent with respect to the drawings. The elements of the drawings are not necessarily illustrated true to scale in relation to each other.

In the figures in the drawing, the same elements, features and components, or those serving the same function and having the same effect, are provided with the same reference numerals in each case—unless otherwise specified.

DESCRIPTION OF EMBODIMENTS

FIG. 1 shows a perspective front view of a cooling fan module 1. The view in FIG. 1 shows the side of the cooling fan module 1 from which the cooling fan module 1 takes in air.

The cooling fan module 1 comprises a frame 3, which has a substantially rectangular form in this embodiment. A recess is provided within the frame 3 in which a fan impeller 2 is located. The fan impeller 2 is fixed by means of assembly struts (not illustrated) to the frame 3. A reverse flow guide device 4 is located between the fan impeller 2 and the frame 3. The reverse flow guide device 4 rectifies a reverse flow which arises as a result of the negative pressure on the intake side, such that the reverse flow no longer swirls in consequence. The reverse flow, as a rectified flow, is mixed with the main flow, which flows centrally through the fan impeller 2, once again and strikes the fan impeller blades 11 of the fan impeller 2 in rectified form.

The frame 3 is made from a plastics material, for example. The frame 3 and the reverse flow guide device 4 may, for example, be designed as separate parts. However, it is advantageous, especially in view of manufacturing costs, to design the frame 3 and the reverse flow guide device 4 as a single-piece plastic injection-moulded part.

FIG. 2 shows a perspective rear view of the cooling fan module 1 shown in FIG. 1. This rear view shows the side of the cooling fan module 1, from which the cooling air flows out of the cooling fan module 1.

The reverse flow guide device 4 is located between the fan impeller 2 and the frame 3. In this embodiment the reverse flow guide device 4 is designed as a reverse flow ring which extends around the circumference of the fan impeller 2. The reverse flow ring comprises an inner ring 5 and an outer ring 6. An air gap 7 is provided between the inner ring 5 and the outer ring 6, the reverse flow from the cooling fan module 1 flowing through said air gap. The inner ring 5 is connected to the outer ring 6 via air guide fins 8. These air guide fins 8 extend around the circumference of the reverse flow ring 4 and are substantially oriented in the radial direction. However, a different configuration of the air guide fins 8, e.g. an oblique orientation, would also be possible. The air guide fins 8 can be designed elastically, i.e. made from an elastic plastics material, for example. The reverse flow guide device 4 also has a profile 9, which diverts the reverse flow such that said flow mixes well with the main flow again. The profile 9 may be provided both on the inner ring 5 and on the outer ring 6.

In this embodiment the fan impeller 2 of the cooling fan module 1 comprises a fan impeller outer ring 12 and a fan impeller hub 10, said hub 10 being connected to the fan impeller outer ring 12 via the fan impeller blades 11. A motor which drives the fan impeller 2 is located at the centre of the hub 10. Other embodiments of fan impellers 2 are also possible of course.

FIG. 3 shows a reverse flow guide device 4 in various representations. The two representations on the left-hand side of FIG. 3 show the reverse flow guide device 4 in a front view and in a view from above. We can see that the inner ring 5 of the reverse flow guide device 4 extends substantially in the axial direction and the outer ring 6 extends substantially in the radial direction. We can also see that the air guide fins 8 are aligned conically with respect to the shaft of the fan impeller 2. This configuration of the air guide fins 8 enlarges the region in which the reverse flow comes into contact with the air guide fins 8. The two upper right-hand representations of the reverse flow guide device 4 in FIG. 3 show the reverse flow guide device 4 in a perspective view from the front and rear respectively. The two lower representations on the right-hand side of FIG. 3 show detailed views of the reverse flow guide device 4 in each case.

FIG. 4 shows a flow diagram for the cooling fan module 1 from the rear. The flow diagram shows the air flow in the region of the reverse flow guide device 4. The arrows 13, 14 show the direction of the air flow at the reverse flow guide device 4. We can see that a flow from the rear side of the cooling fan module 1 is sucked to the front side of the cooling fan module 1 through the air gap 7 in the reverse flow guide device 4. This reverse flow 13 is caused by the negative pressure prevailing at the front side of the cooling fan module 1. This reverse flow 13 is not a swirling flow. The reverse flow 13 is rectified by the air guide fins 8 and by the profile 9 as it passes through the air gap 7, is mixed with the strongly swirling fan impeller gap flow and is then sucked back with the main flow on the front side of the cooling fan module 1 with reduced spin. As a result the main flow displays less turbulence, which leads to the cooling fan module having an improved flow behaviour and to correspondingly reduced noise formation by the cooling fan module 1.

FIG. 5 shows a flow diagram for the cooling fan module 1 from the front. We can see that the reverse flow 13 no longer swirls after passing through the reverse flow guide device 4 and mixes well with the fan impeller gap flow and the main flow 14 of the cooling fan module 1.

FIG. 6 shows a perspective sectional view of a further embodiment of a cooling fan module 1. In this embodiment of the cooling fan module 1, the fan impeller outer ring 12 is located between the inner ring 5 of the reverse flow guide device 4 and the outer ring 6 of the reverse flow guide device 4. As a result there is an outer air gap 16 between the fan impeller outer ring 12 and the outer ring 6 of the reverse flow guide device 4 and an inner air gap 15 between the fan impeller outer ring 12 and the inner ring 5 of the reverse flow guide device 4. The outer ring 6 has an outer ring section 17 which extends in the axial direction. The outer ring 6 of the reverse flow guide device 4 also has an outer ring section 18, which extends substantially in a radial direction. The inner ring 5 of the reverse flow guide device 4 also has an inner ring section 19, which extends in the axial direction of the cooling fan module 1 and an inner ring section 20 which extends substantially in a radial direction. A transition 21 in the form of a bend may be formed between the inner ring section 19 and the inner ring section 20.

A transition may also be provided between the outer ring section 17 and the outer ring section 18 in the form of a curve. The air guide fins 8 which are provided between the inner ring 5 and the outer ring 6 of the reverse flow guide device 4 extend substantially in the radial direction in this embodiment of the cooling fan module 1.

In this embodiment of the impeller gap, the outer air gap 16 is designed to guide a reverse flow from the discharge side of the cooling fan module to the intake side of the cooling fan module in substantially the same direction. In the embodiment of the cooling fan module 1 illustrated in FIG. 6, the discharge side of the cooling fan module is on the right-hand side and the intake side of the cooling fan module is on the left-hand side.

The inner air gap 15 is designed to generate a flow which has substantially the same direction as the main air flow of the fan impeller 2, thus from left to right in the example shown in FIG. 6. In other words, the inner air gap 15 is designed such that it extracts vortex-free air on the intake side of the cooling fan module and passes it to the impeller gap flow of the cooling fan module 1. The air flows radially into the reverse flow guide device 4, is guided by the air guide fins 8, is then mixed with the impeller gap flow which flows in the outer air gap 16, and then flows in the direction of the fan impeller 2. Vortex effects are removed from the impeller gap flow (reverse flow) which arises in the outer air gap 16 by the flow in the inner air gap 15 by mixing. The performance of the cooling fan module is increased in this manner. The noise generated by the cooling fan module 1 is also reduced in this manner. The efficiency of the cooling fan module 1 can also be improved even more as a result. The air guide fins 8 can also extend either obliquely or in a curved manner.

According to an advantageous embodiment, the air guide fins 8 and/or the transition 21 are designed elastically so that the inner ring 5 can be moved with respect to the outer ring 6, such that the fan impeller 2 can be inserted through the reverse flow guide device 4. The entire inner ring 5 can also be made from an elastic material. A reverse flow guide device 4 designed in this manner may, for example, be manufactured in a two-component injection moulding method.

In a further embodiment the reverse flow guide device 4 is designed as a separate component and is not integral with the frame 3.

FIG. 7 shows a perspective rear view of a section of the cooling fan module 1 shown in FIG. 6. In this view we can see that the outer ring section 17 extends substantially in the axial direction of the cooling fan module 1. A reverse flow flows from the rear side to the front side of the cooling fan module 1 in the outer air gap 16. The main flow in the cooling fan module 1 flows from right to left in the cooling fan module 1 shown in FIG. 7, whereas the reverse flow (impeller gap flow) 16 flows from left to right.

FIG. 8 shows a perspective front view of the cooling fan module 1 shown in FIG. 6. The motor 10, which is located in the hub of the fan impeller 2 and drives the fan impeller 2, is connected to the frame 3 by means of fixing struts (not illustrated). If the air guide fins 8 and/or the transition 21 are designed elastically, it is possible to insert the fan impeller 2 along with the motor 10 through the reverse flow guide device 4 to mount on the fixing struts.

In the illustrated example the fan impeller 2 is inserted from left to right through the reverse flow guide device 4, the air guide fins 8 and/or the transition 21 being elastically deformed on passing through the fan impeller 2, and resuming their original shape after passing through. The cooling fan module 1 can thus be manufactured and assembled in a particularly simple manner.

FIG. 9 shows a further perspective rear view of the cooling fan module 1 shown in FIG. 6. Fixing struts (not illustrated) are provided on the frame 3 on the rear side of the cooling fan module 1, said struts connecting the fan impeller 2 along with the motor 10 to the frame 3.

FIG. 10 shows an embodiment of a fan impeller 2. This fan impeller 2 may also be used without a reverse flow guide device 4, for example in a cooling fan module 1, which is designed in a different way to the fan impeller described in FIGS. 1 to 9. The fan impeller 2 in this embodiment comprises a large number of fan impeller blades 11, which extend outwards from a hub 25, or in other words in the radial direction. The fan impeller blades 11 are connected to one another on the outer peripheral line of the fan impeller 2 by means of a fan impeller outer ring 12. The fan impeller outer ring 12 comprises a fan impeller outer ring section 111, which extends in the radial direction, whereas the fan impeller outer ring 12 extends in the axial direction. A second fan impeller outer ring 22 is provided parallel to the fan impeller outer ring section 111, said second fan impeller outer ring being connected to the fan impeller outer ring section 111 via a large number of outer ring air guide fins 23. The outer ring air guide fins 23 are designed to generate an air flow in the radial direction between the fan impeller outer ring section 111 and the second fan impeller outer ring 22 from the outside to the inside or from the inside to the outside. To this end, the outer ring air guide fins 23 are arranged at a suitable angle for this purpose.

According to requirements and the application environment, the fan impeller air guide fins 23 are arranged at such an angle that there is an air flow in a radial direction from the outside to the inside or from the inside to the outside. The efficiency of the cooling fan module 1 can be increased even more in this manner, as this thus leads to an optimised flow profile. The swirling fan gap flow is extracted from the fan gap in this manner and no longer contributes to turbulence in the intake flow in this case. The noise emitted by the cooling fan module 1 is reduced even more in this manner.

The fan impeller 2 illustrated in FIG. 11 may for example be designed as a one-piece injection-moulded part. It is also possible to design the second fan impeller outer ring 22 along with the outer ring air guide fins 23 as a separate component which can be connected to a traditional fan impeller 2. By way of example, the second fan impeller outer ring 22 can be connected to the fan impeller 2 by adhesive bonding and/or friction welding.

FIG. 12 shows a further representation of the fan impeller 2 in a perspective side view.

FIG. 13 shows a perspective top view of the fan impeller 2 shown in FIG. 10. The fan impeller 2 which is illustrated in FIG. 13 rotates to the right, for example, as shown by the arrow 30. In this case the outer ring air guide fins 23 are provided such that a flow is generated between the fan impeller outer ring 12 and the second fan impeller outer ring 22, which flows from the inside to the outside.

If the direction of rotation of the fan impeller 2 is reversed, i.e. in the opposite direction to that shown by the arrow 30, a flow would be generated between the fan impeller outer ring 12 and the second fan impeller outer ring 22, which flows from the outside to the inside.

FIG. 14 shows a perspective sectional view of the fan impeller 2 shown in FIG. 10. The section runs through the outer ring air guide fins 23 and the fan impeller blades 11 in this case. The cut surfaces are shown as dark colours. If the fan impeller 2 rotates to the left, as indicated by the arrow 31, an air flow is generated which flows from the outside to the inside, as indicated by the arrow 32. The outer ring air guide fins 23 may also be provided in a curved shape.

Although the present invention has been fully described above by means of preferred embodiments, it is not limited to the above, but may be modified in a number of ways.

LIST OF REFERENCE NUMERALS

1 cooling fan module
2 fan impeller
3 frame
4 reverse flow guide device
5 inner ring
6 outer ring
7 air gap
8 air guide fins
9 profile
10 hub with motor
11 fan impeller blades
12 (first) fan impeller outer ring
13 reverse flow
14 main flow
15 inner air gap
16 outer air gap
17 outer ring section
18 outer ring section
19 inner ring section
20 inner ring section
21 transition
22 (further, second) fan impeller outer ring
23 outer ring air guide fins
25 hub
30 direction of rotation
31 direction of rotation
111 fan impeller outer ring section

The invention claimed is:

1. Cooling fan module for a motor vehicle,
comprising a fan impeller which comprises a plurality of fan impeller
blades which are connected to one another by means of a fan impeller outer ring, comprising a frame on which the fan impeller is mounted,
wherein a separate annular reverse flow guide device is provided,
comprising an inner ring and an outer ring, wherein the reverse flow guide device comprises a plurality of air guide fins which are provided between the inner ring and the outer ring and defining an opening at a discharge side of the fan, and which is designed to de-spin a reverse flow between the inner ring and the outer ring and to mix said reverse flow with a gap flow between the inner ring and the fan impeller outer ring, wherein the fan impeller outer ring is located between the inner ring and the outer ring of the reverse flow guide device.

2. Cooling fan module according to claim 1,
wherein the air guide fins are designed elastically such that the fan impeller is designed to be inserted through the reverse flow guide device.

3. Cooling fan module according to claim 1,
wherein the frame is made from a thermoset plastics material and the air guide fins are made from a thermoplastic or elastomer plastics material.

4. Cooling fan module according to claim 1,
wherein the frame is designed as a plastic injection molded part.

5. Cooling fan module according to claim 1,
wherein the fan impeller comprises a second fan impeller outer ring which is connected to the fan impeller outer ring by means of a plurality of outer ring air guide fins, said outer ring air guide fins being designed such that a radial air flow is generated between the fan impeller outer ring and the second fan impeller outer ring.

* * * * *